United States Patent [19]

Hirakawa et al.

[11] 4,327,854

[45] May 4, 1982

[54] APPARATUS FOR GUIDING WEB-LIKE MATERIAL

[75] Inventors: Tadashi Hirakawa; Hiroshi Satou, both of Mihara, Japan

[73] Assignee: Mitsubishi Jukogyo Kabushiki Kaisha, Tokyo, Japan

[21] Appl. No.: 173,677

[22] Filed: Jul. 30, 1980

[30] Foreign Application Priority Data

Aug. 7, 1979 [JP] Japan ..... 54-108736

[51] Int. Cl.[3] ..... B65H 11/28; B65H 25/06

[52] U.S. Cl. ..... 226/95; 226/1

[58] Field of Search ..... 226/1, 95, 97, 7, 195, 226/199; 242/75.2

[56] References Cited

U.S. PATENT DOCUMENTS 3,166,310 1/1965 Kittredge ..... 271/5
3,385,495 5/1968 Shields ..... 226/95
3,649,381 3/1972 Mayhew ..... 226/7
3,788,515 1/1974 Middleman ..... 226/1
3,871,564 3/1975 Middleman ..... 226/1

*Primary Examiner*—Edward J. McCarthy
*Attorney, Agent, or Firm*—Bernard, Rothwell & Brown

[57] ABSTRACT

An apparatus for guiding web-like materials is provided with a hollow suction box having a surface for making a contact with a continuously running web-like material. A plurality of bores are formed in the surface of the suction box within a region corresponding to the maximum sheet width at a suitable pitch. Each of the bores have a smaller diameter at its inner side than at its outer side. A sucking mechanism of adjustable pressure is provided in communication with the cavity of the hollow suction box. A damper is disposed at the duct of the sucking mechanism and is used for adjusting the pressure in suction box.

3 Claims, 11 Drawing Figures

APPARATUS FOR GUIDING WEB-LIKE MATERIAL

BACKGROUND OF THE INVENTION

1. Field of the Invention

The invention relates to an apparatus for guiding a web-like material applicable to an apparatus for guiding single-faced corrugated board or liner in a corrugate machine.

2. Description of the Prior Art

A typical conventional suction-box type guiding apparatus in a corrugate machine have been illustrated in FIGS. 1 and 2. A single-faced corrugated board 1 is moved from a single facer 2 to a double facer 4 via a guiding apparatus 3, while a liner 5 is unrolled from a roll on a mill roll stand 6 and moved to the double facer 4 through the guiding apparatus 3.

It is a common measure to guide and tense the single-faced corrugated board 1 formed by the single facer 2 before the board 1 comes into the double facer 4, by means of the guiding apparatus 3. However, the provision of the guiding apparatus for imparting a tension to the liner 5 is considered as an application.

Referring to FIG. 2, a suction box 9 disposed between inlet and outlet guide rolls 7, 8 is subjected to a pressure lower than the atmospheric pressure, by means of a blower 10. A perforated plate 11 is provided on the side of the suction box 9 where the single-faced corrugated board 1 runs, and is adapted to make a smooth sliding contact with the latter. The negative pressure in the suction box 9 attracts the single-faced corrugated board 1 toward the suction box 9 to impart a tension to the single-faced corrugated board 1. The guiding apparatus for the liner is installed substantially in the same manner.

Usually, the guiding apparatus are operated with various widths of single-faced corrugated board 1 and liner 5, from the maximum width to a width about a half of the maximum width, in accordance with the size of the corrugated cardboard box which is the final product. In order to make it possible to adjust the region of negative pressure in the suction box 9, a piston 12 is attached to a screw shaft 13, motor 14 and a guide shaft 15, and is disposed at the inside of the plate 11.

However, in the conventional apparatus having the described construction, it is necessary to change the region of the negative pressure in the suction box 9 in accordance with the change of the sheet width, for otherwise absolute value of the negative pressure is undesirably reduced due to sucking of air through the bores which are located outside the width of the sheet. The change of the sheet width is usually made 50 to 100 times a day, at each of which the adjustment of the range of negative pressure in the suction box 9 has to be made. Thus, the conventional guiding apparatus requires a very troublesome work for treating sheets of various widths.

In addition, this adjustment of the range of negative pressure requires a highly complicated construction including the aforementioned piston 12, screw 13, motor 14 and the guide shaft 15, resulting in a raised cost of the apparatus.

In addition, it is necessary to provide a display device to display the region of negative pressure in the suction box, as well as a device for presetting the region of negative pressure of the next order, resulting in a further complicated construction and further raised cost of the apparatus. In addition, the aforementioned piston 12, screw shaft 13, guide shaft 15 and other associated parts can hardly be checked because they are accommodated by the suction box 9.

SUMMARY OF THE INVENTION

Accordingly, the present invention aims at providing a guiding apparatus for web-like material which does not require the change of region of the negative pressure even when the sheet width is changed, thereby to overcome the above-described problems of the prior art.

To this end, according to the invention, there is provided a hollow suction box having a surface for making a contact with a continuously running web-like material. A plurality of bores are formed in the surface of the suction box within a region corresponding to the maximum sheet width at a suitable pitch. Each of the bores have a smaller diameter at its inner side than at its outer side. A sucking mechanism of adjustable pressure is provided in communication with the cavity of the hollow suction box.

DESCRIPTION OF THE PREFERRED EMBODIMENTS

Figure 1:
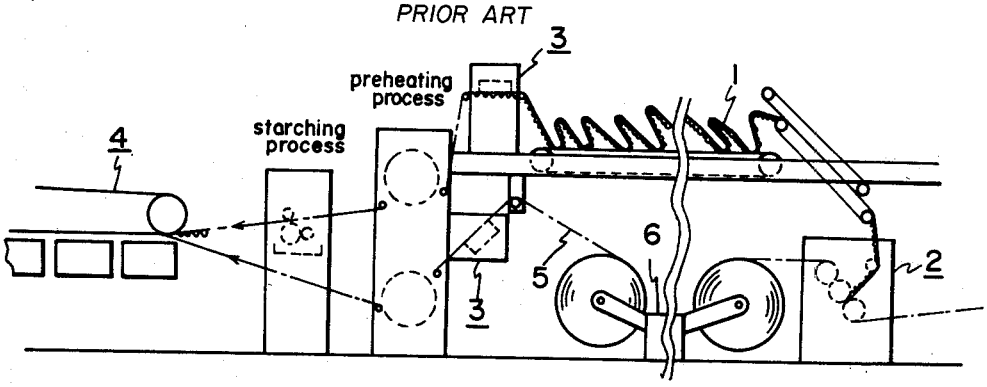
FIG. 1 PRIOR ART
FIG. 1 is a side elevational view of a corrugate machine having a conventional suction box type guiding apparatus.
Figure 2:
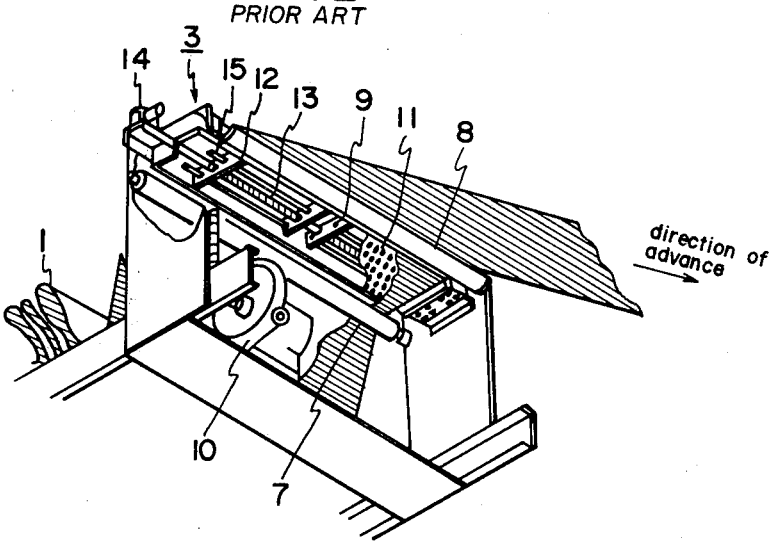
FIG. 2 PRIOR ART
FIG. 2 is a perspective view of the guiding apparatus shown in FIG. 1.
Figure 3:
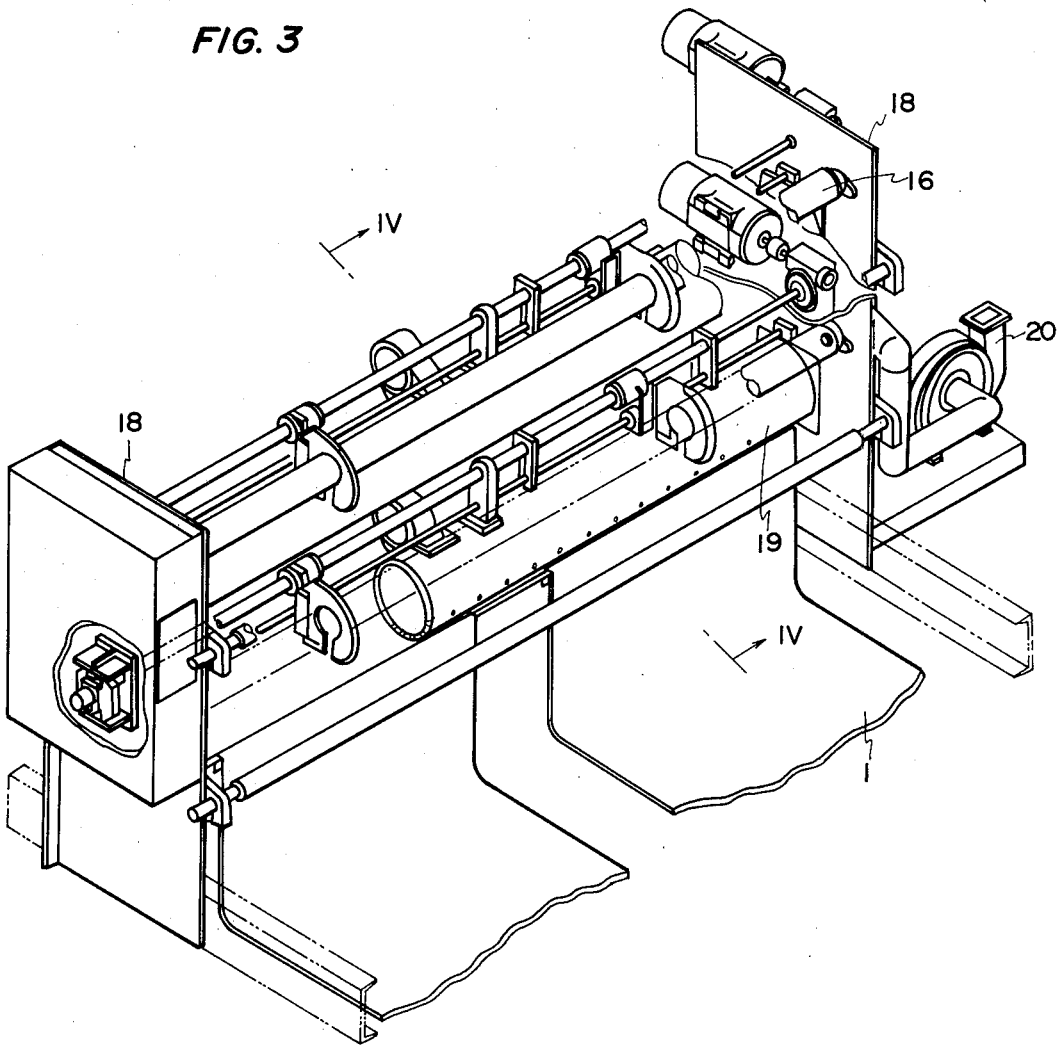
FIG. 3 is a perspective view of an apparatus for guiding web-like materials constructed in accordance with a first preferred embodiment of the invention.
Figure 4:
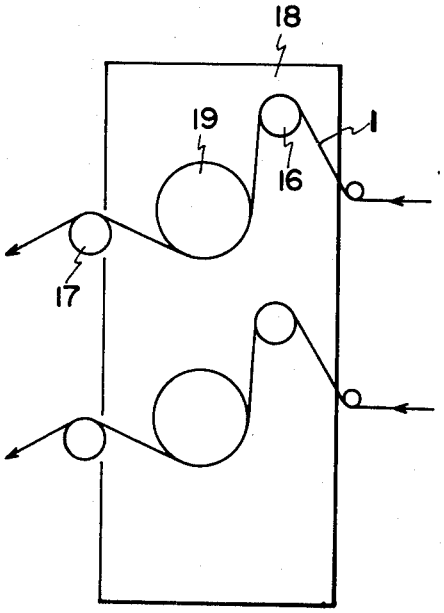
FIG. 4 is a schematic sectional view taken along the line IV—IV in FIG. 3.

Preferred embodiments of the invention will be described with reference to the accompanying drawings.

A first embodiment of the present invention is shown in FIGS. 3 to 8. Referring to these Figures, an inlet and outlet guide rolls 16 and 17 are mounted rotatably on a frame 18 to which attached also is a suction box 19. The cavity in the suction box 19 is subjected to a negative pressure produced by a blower 20.

The detail of the suction box 19 will be described with specific reference to FIGS. 4 to 7. A plurality of bores 21 are formed at a suitable pitch in the angle portion $\theta$ of the suction box 19 contacting the single-faced corrugated board 1 within the region of the maximum width of the sheet treated by this apparatus. The bore 21 has an extremely small diameter of 2 to 5 mm.

Further, the outer portion 21b of the bore 21 opening to the sheet-contacting outer surface of the suction box has a diameter greater than the inner portion 21a. A reference numeral 22 denotes a damper which is used for adjusting the negative pressure in the suction box 19.

In operation, the single-faced corrugated board 1 produced by the single facer is transferred to the double facer while being suitably tensed and guided by the guiding apparatus.

A relationship expressed by the following equation (1) exists between the tension F imparted to the single-face corrugated board 1 and the negative pressure P in the suction box 19.

$$F = C \times r \times l \times P(e^{\mu\theta} - 1) \quad (1)$$

r: radius of suction box l: widthwise length of single-faced corrugated board $\theta$: angle of the portion of the suction box contacting the single-faced corrugated board (angle of perforated portion)

C: suction efficiency (a constant determined by porosity (total area of bores/area of sheet-contact surface) and other factors)

$\mu$: coefficient of friction between the sheet-contacting surface of the suction box and the smoother side of the single-faced corrugated board The tension F/l per unit width is proportional to the pressure P. It is an ordinary operating method to keep the tension F/l constant for varying sheet width. In other words, it is an ordinary way to maintain the level of the negative pressure P irrespective of the change of the sheet width.

Assuming here that the sheet width is changed from the maximum width to a half of the maximum width, air is induced through the bores 21 which are out of the sheet width so that the level of the negative pressure in the suction box 19 produced by the blower 20 is lowered correspondingly.

The relationship between the negative pressure P and the velocity v of the air flowing through the bore 21 is given by the following equation (2).

$$v = \sqrt{2g\frac{P}{\gamma}} \quad (2)$$

g: gravity accerleration (9.8)

Y: specific weight of air (1.165 at 20° C.)

Also, the following relationship exists between the flow rate Q of air flowing through the bores 21 and the velocity v of the same.

$$Q = vA \quad (3)$$

A: total area of bores through which the air flows

Figure 8:
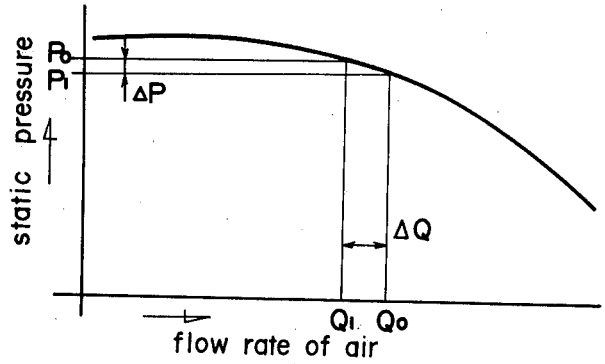
FIG. 8 is a graphic diagram showing the relationship between the flow rate of air and the static pressure.

FIG. 8 shows a general characteristic between the flow rate Q of air induced by the blower 20 and the static pressure (negative pressure) P. The flow rates of air induced by the blower at the maximum sheet width and the half sheet width are represented, respectively, by $Q_0$ and $Q_1$. Similarly, the pressure at the maximum sheet width and the half sheet width are represented, respectively, by $P_0$ and $P_1$.

Figure 5:
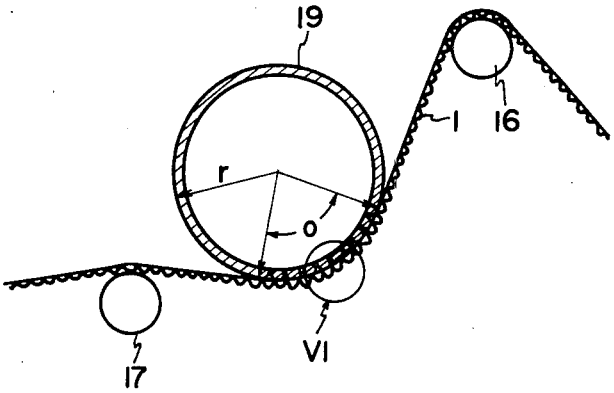
FIG. 5 is a detailed illustration of an essential part of the apparatus shown in FIG. 4.
Figure 6:
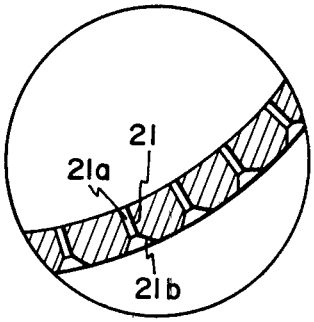
FIG. 6 is an enlarged view of a portion marked at VI in FIG. 5.
Figure 7:
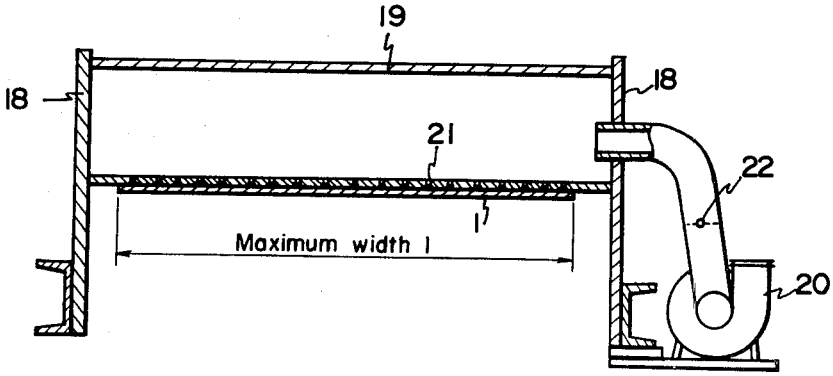
FIG. 7 is a front elevational sectional view of a suction box shown in FIG. 3.

According to the invention, as will be seen from FIG. 5, each bore 21 has a smaller diameter at its inner portion 21a, so that the flow rate of air sucked through the bores 21 is reduced to decrease the reduction P of the static pressure. This reduction P corresponds to the difference between $P_0$ and $P_1$ shown in FIG. 8.

The negative pressure in the suction box 19 acts to attract the single-faced corrugated board 1 toward the surface of the suction box 19 thereby to impart a tension to the board 1. If the bore 21 has a small diameter at its outer side opening to the sheet-contacting surface, the attracting force will be reduced to lower the level of the tension. According to the invention, however, the outer portion 21b of the bore 21 opening to the sheet-contacting surface has a greater diameter than the inner portion 21a of the same, so that the negative pressure in the suction box can act on a larger area of the single-faced corrugated board to attract the board 1 with a stronger force.

Table 1 shows the levels of force for attracting the single-faced corrugated board in relation to the levels of the negative pressure in the suction box.

TABLE 1

| | vacuum in cylinder bore | force required for tensing sheet | suction box radius 160 mm | |
|---|---|---|---|---|
| | | | suction efficiency | condition |
| | 150 mmAq | 15 Kg | 0.735 | sheet width 1000 |
| A | 200 mmAq | 22 Kg | 0.81 | mm winding angle |
| | 250 mmAq | 29 Kg | 0.852 | 112° bore dia. 3 drill, divergence 14$\phi$ pitch 40 mm |
| | 80 mmAq | 15 Kg | 0.76 | sheet width 1000 |
| B | 170 mmAq | 32 Kg | 0.76 | mm winding angle |
| | 260 mmAq | 48 Kg | 0.75 | 160° bore dia. 14 drill pitch 40 mm |

The item A in Table 1 above has bores 21 formed at a pitch of 40 mm, each bore being a through bore of 3 drill and diverged end diameter (diameter at outer portion 21b) of 14$\phi$, while item B has bores 21 formed at 40 mm pitch, each bore consisting of 14 drill. As will be understood from the Table 1 above, there is no substantial difference of suction efficiency between item B in which 14 drill through bores are formed and the item A in which 3 drill through drill bores are formed to have divergence of 14$\phi$, so that no substantial difference of tension is caused therebetween.

Figure 9:
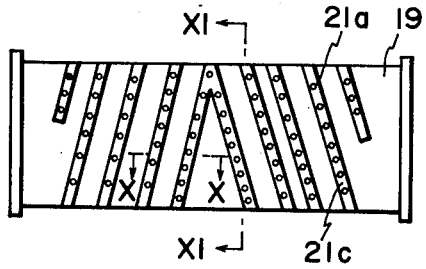
FIG. 9 is a side elevational view of a suction box constructed in accordance with a second preferred embodiment of the invention.
Figure 10:
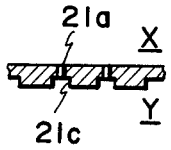
FIG. 10 is an enlarged sectional view taken along the line X—X in FIG. 9.
Figure 11:
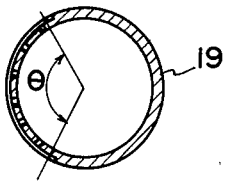
FIG. 11 is a sectional view taken along the line XI—XI in FIG. 9.

FIGS. 9 to 11 show another embodiment in which a plurality of grooves 21c are formed in the sheet-contacting surface of the suction box, and the inner portion 21a of the bores 21 is formed in the bottom of each groove 21c. It is possible to stretch the wrinkled sheet and to prevent the winding of the sheet by arranging such that the grooves 21c are diverged toward the downstream side as viewed in the direction of running of the sheet. This second embodiment provides a substantially same advantage as the first embodiment. In FIG. 10, reference symbols X and Y represent, respectively, the inside and the outside of the suction box.

As has been described, according to the invention, the bores formed in the sheet-contacting surface of the suction box has a smaller diameter at their inner sides than at the outer sides, so that the change of level of negative pressure in the suction box is decreased even when the sheet width is changed, without necessitating the adjustment of region of application of the negative pressure. In addition, since the bores have greater diameter at their outer sides contacting the sheet, a greater force is obtained for sucking the web-like material.

What is claimed is:

1. An apparatus for guiding a continuously running web-like material and imparting a tension to said web-like material comprising:

a hollow suction box having a surface for contacting said web-like material;

a plurality of bores formed in said surface within a range corresponding to the maximum width of said web-like material at;

each of said bores having a smaller diameter at its inner side than at its outer side; and a sucking mechanism of adjustable sucking force and communicated with the cavity in said hollow suction box.

2. An apparatus according to claim 1 wherein said bores comprise a plurality of grooves formed in the contacting surface of said web-like material, and a plurality of bores having a smaller diameter than the width of said grooves formed in the bottom of each said groove.

3. An apparatus according to claim 1 or 2 wherein said sucking mechanism comprises a blower, a pipe connecting said blower with said cavity in said hollow suction box, and a damper for adjusting the sucking force disposed in said pipe.

* * * * *